US008611766B2

(12) United States Patent
Kawai

(10) Patent No.: US 8,611,766 B2
(45) Date of Patent: Dec. 17, 2013

(54) REPLACEMENT TONER CARTRIDGE MANAGEMENT APPARATUS, REPLACEMENT TONER CARTRIDGE MANAGEMENT SYSTEM, IMAGE FORMING APPARATUS, REPLACEMENT TONER CARTRIDGE MANAGEMENT METHOD, AND RECORDING MEDIUM

(75) Inventor: Atsushi Kawai, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 326 days.

(21) Appl. No.: 13/191,671

(22) Filed: Jul. 27, 2011

(65) Prior Publication Data

US 2012/0027424 A1 Feb. 2, 2012

(30) Foreign Application Priority Data

Jul. 28, 2010 (JP) ..... 2010-169874

(51) Int. Cl.
*G03G 15/00* (2006.01)

(52) U.S. Cl.
USPC ..... 399/12; 399/13; 399/27

(58) Field of Classification Search
USPC ..... 399/12, 13, 27
See application file for complete search history.

(56) References Cited

U.S. PATENT DOCUMENTS

| | | | | |
|---|---|---|---|---|
| 6,798,995 | B2 | 9/2004 | Nagata | |
| 7,031,623 | B2 * | 4/2006 | Haramoto | 399/12 |
| 7,986,888 | B2 * | 7/2011 | Hibino | 399/12 |

FOREIGN PATENT DOCUMENTS

| | | | |
|---|---|---|---|
| JP | 2002-127572 | A | 5/2002 |
| JP | 2002-297969 | A | 10/2002 |
| JP | 2002-304278 | A | 10/2002 |
| JP | 2004-013750 | A | 1/2004 |
| JP | 2006-313226 | A | 11/2006 |
| JP | 2007-256863 | A | 10/2007 |
| JP | 2008-243018 | A | 10/2008 |
| JP | 2008-271231 | A | 11/2008 |

OTHER PUBLICATIONS

Office Action (Notification of Reasons for Refusal) dated Jun. 5, 2012, issued in corresponding Japanese Patent Application No. 2010-169874, and an English Translation thereof. (9 pages).

* cited by examiner

*Primary Examiner* — Hoang Ngo
(74) *Attorney, Agent, or Firm* — Buchanan Ingersoll & Rooney PC

(57) ABSTRACT

A replacement toner cartridge management apparatus is provided with: a receiver which receives first information indicating that a toner cartridge has been replaced with a new one and second information indicating that the remaining amount of toner contained in a toner cartridge reaches a predetermined value, from one or more than one image forming apparatus which the replacement toner cartridge management apparatus can access via a communication circuit; a determiner which determines the right type of a replacement toner cartridge to be loaded in place of the toner cartridge causing the first information or the second information, depending on which is received by the receiver, the first information or the second information; and a transmitter which outputs an instruction to deliver a replacement toner cartridge of the type determined by the determiner.

18 Claims, 13 Drawing Sheets

Display the following messages depending on remaining toner information:

①Normal:
(No message displayed)
②Toner Near Empty:
"There will be a need for toner cartridge replacement in a short time."
③Toner Empty(permit printing):
"The toner cartridge is running out of toner. Please replace. "
(Printing is available when receiving the information 1,2 or 3)

Toner Empty(prohibit printing):
"The toner cartridge has run out of toner. Please immediately replace. "(Strong alert message)(Printing is not available when receiving this information)

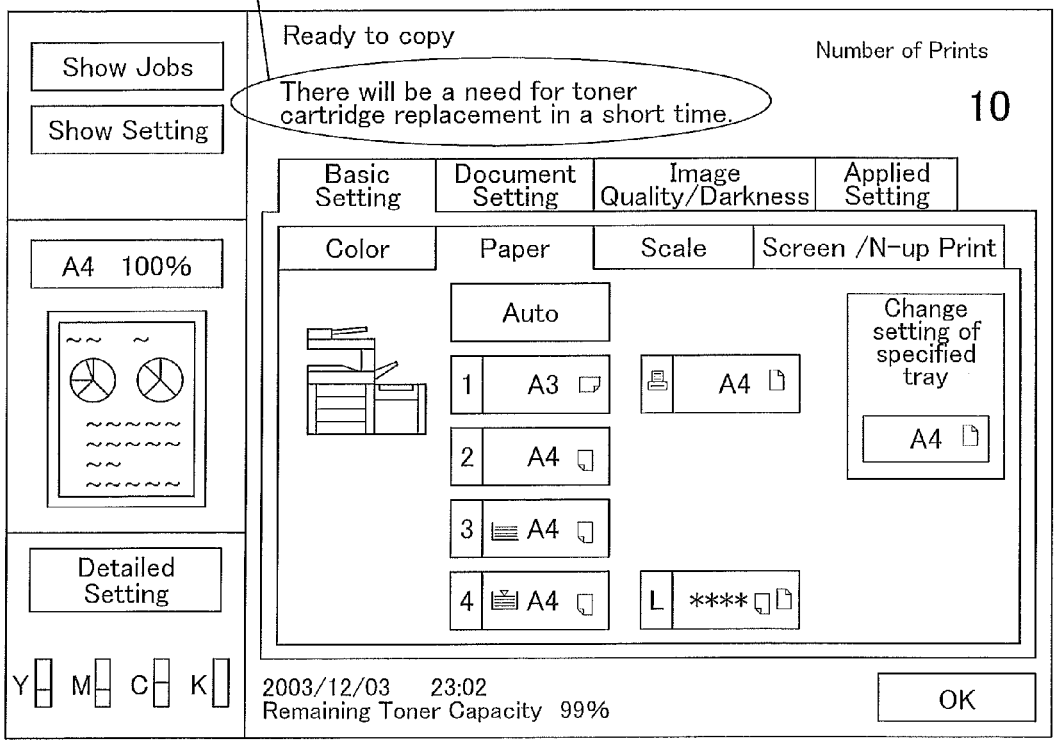

FIG.9

| Remaining Toner Information | Permit/ Prohibit Printing | Panel Display | Toner State |
|---|---|---|---|
| Normal | Permit printing | (No message displayed) | The sub-hopper and the toner cartridge hold enough toner. |
| Toner Near Empty | Permit printing | One-line message: "There will be a need for toner cartridge replacement in a short time." | The sub-hopper holds some toner but the toner cartridge nearly runs out of toner. |
| Toner Empty (permit printing) | Permit printing | One-line message: "The toner cartridge is running out of toner. Please replace." | The sub-hopper holds some toner but the toner cartridge absolutely runs out of toner. |
| Toner Empty (prohibit printing) | Prohibit printing | Strong Alert message: "The toner cartridge has run out of toner. Please immediately replace and close the toner garage door." | The sub-hopper and the toner cartridge absolutely run out of toner, and printing is not available any more due to low toner concentration. |

FIG.10

REPLACEMENT TONER CARTRIDGE MANAGEMENT APPARATUS, REPLACEMENT TONER CARTRIDGE MANAGEMENT SYSTEM, IMAGE FORMING APPARATUS, REPLACEMENT TONER CARTRIDGE MANAGEMENT METHOD, AND RECORDING MEDIUM

This application claims priority under 35 U.S.C. §119 to Japanese Patent Application No. 2010-169874 filed on Jul. 28, 2010, the entire disclosure of which is incorporated herein by reference in its entirety.

BACKGROUND OF THE INVENTION

1. Field of the Invention

The present invention relates to a replacement toner cartridge management apparatus which manages replacement toner cartridges to be loaded in place of toner cartridges loaded on an image forming apparatus; a replacement toner cartridge management system which employs the replacement toner cartridge management apparatus; an image forming apparatus employed in the replacement toner cartridge management system; a replacement toner cartridge management method; and recording mediums.

2. Description of the Related Art

The following description sets forth the inventor's knowledge of related art and problems therein and should not be construed as an admission of knowledge in the prior art.

Conventionally, if the remaining consumable resource in a consumable unit loaded on an image forming apparatus such as an electrophotographic copier, an electrophotographic printer, or an electrophotographic multifunctional machine called MFP (Multi Function Peripheral), for example, the amount of remaining toner in a toner cartridge is lower than a predetermined level, the image forming apparatus determines that the toner cartridge will run out of toner in a short time (the toner cartridge is nearly empty) and displays a message stating that the toner cartridge is nearly empty on a display panel provided thereon so that the user can notice it. Noticing this message, the user prepares a replacement toner cartridge, or places an order for a replacement toner cartridge if not having it in stock.

Meanwhile, in recent years, an image forming apparatus which is connected with a management apparatus to exchange information with has been more commonly used in a remote management system (for example, Japanese Unexamined Patent Publication No. 2002-297969). In many cases, a retailer of image forming apparatuses or a provider of office supplies have their own management apparatus in their own place, in order to collect, store, and manage for their business, various types of information including toner near empty information from a plurality of image forming apparatuses in their users' places. Being connected with the image forming apparatuses, the management apparatus is capable of recognizing a nearly empty toner cartridge or a new toner cartridge having been loaded thereon.

In some cases, the management apparatus is further connected with an order receiving apparatus receiving orders for a replacement toner cartridge (for example, Japanese Unexamined Patent Publication No. 2008-271231). In such a case, the management apparatus further transmits an order to the order receiving apparatus, so that a replacement toner cartridge will be delivered to the user. In other words, this is exactly a system to automatically deliver replacement toner cartridges to users while they need not bother to place an order for them.

Such an automatic order and delivery system is very useful if the manufacturer and the user are in an agreement about billing and payment for the use of an image forming apparatus. In accordance with such an agreement, the user pay a service fee for making one copy, which includes a charge for the toner used for the copy. That is, it is convenient for the user to pay a service fee simply depending on the number of copies regardless of how many replacement toner cartridges they ordered and have a replacement toner cartridge automatically delivered without the need for placing an order for it. At the same time, the manufacturer can expect a benefit from saving the costs of handling order transactions.

There are some such systems which have been developed which automatically place an order and deliver a replacement toner cartridge according to information such as a notice of toner empty from an image forming apparatus which is connected to a management apparatus. In such a system, a replacement toner cartridge generally will be delivered when an image forming apparatus detects a new toner cartridge having been loaded thereon or a nearly empty toner cartridge. Furthermore, an image forming apparatus generally detects a new toner cartridge having been loaded thereon, by having a fuse or the like of the new toner cartridge cut off due to setting, or by obtaining information from a memory chip of the new toner cartridge.

While such systems which automatically place an order and deliver a replacement toner cartridge have been developed, there is a need to finish the use of such a feature to detect a new toner cartridge, including a memory chip and a fuse, in order to reduce the costs of toner cartridges.

Without using such a toner cartridge detection feature, an image forming apparatus needs to examine after detecting an empty toner cartridge, if its sub-hopper is refilled with toner, in order to judge whether or not a new toner cartridge has been loaded. And it is not convenient that before or without detecting an empty toner cartridge, an image forming apparatus cannot judge whether or not it is replaced with a new one. As described above, an image forming apparatus cannot successfully detect a new toner cartridge having been loaded thereon, unless the new toner cartridge has a new toner cartridge detection feature.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

According to a first aspect of the present invention, a replacement toner cartridge management apparatus is provided with:

a receiver which receives first information indicating that a toner cartridge has been replaced with a new one and second information indicating that the remaining amount of toner contained in a toner cartridge reaches a predetermined value, from one or more than one image forming apparatus which the replacement toner cartridge management apparatus can access via a communication circuit;

a determiner which determines the right type of a replacement toner cartridge to be loaded in place of the toner cartridge causing the first information or the second information, depending on which is received by the receiver, the first information or the second information; and a transmitter which outputs an instruction to deliver a replacement toner cartridge of the type determined by the determiner.

According to a second aspect of the present invention, a replacement toner cartridge management system is provided with one or more than one image forming apparatus having one or more than one toner cartridge loaded thereon and a management server which can access each other via a communication circuit, wherein:

the image forming apparatus is provided with a transmitter which transmits first information indicating that a toner cartridge has been replaced with a new one and second information indicating that the remaining amount of toner contained in a toner cartridge reaches a predetermined value; and the management apparatus is provided with:

a receiver which receives the first information and the second information;

a determiner which determines the right type of a replacement toner cartridge to be loaded in place of the toner cartridge causing the first information or the second information, depending on which is received by the receiver, the first information or the second information; and a transmitter which outputs an instruction to deliver a replacement toner cartridge of the type determined by the determiner.

According to a third aspect of the present invention, an image forming apparatus is provided with:

a detector which detects first information indicating that a toner cartridge loaded thereon has been replaced with a new one and second information indicating that the remaining amount of toner contained in a toner cartridge loaded thereon reaches a predetermined value;

a determiner which determines the right type of a replacement toner cartridge to be loaded in place of the toner cartridge causing the first information or the second information, depending on which is detected by the detector, the first information or the second information; and a transmitter which outputs an instruction to deliver a replacement toner cartridge of the type determined by the determiner.

According to a fourth aspect of the present invention, a replacement toner cartridge management method implemented by a replacement toner cartridge management system provided with one or more than one image forming apparatus having one or more than one toner cartridge loaded thereon, and a management apparatus which can access each other via a communication circuit, includes:

the image forming apparatus's transmitting first information indicating that a toner cartridge has been replaced with a new one and second information indicating that the remaining amount of toner contained in a toner cartridge reaches a predetermined value; and the management apparatus's:

receiving the first information and the second information;

determining the right type of a replacement toner cartridge to be loaded in place of the toner cartridge causing the first information or the second information, depending on which is received, the first information or the second information; and outputting an instruction to deliver a replacement toner cartridge of the determined type.

According to a fifth aspect of the present invention, a recording medium has a replacement toner cartridge management program stored thereon to make a computer of a replacement toner cartridge management apparatus execute:

receiving first information indicating that a toner cartridge has been replaced with a new one and second information indicating that the remaining amount of toner contained in a toner cartridge reaches a predetermined value, from one or more than one image forming apparatus which the replacement toner cartridge management apparatus can access via a communication circuit;

determining the right type of a replacement toner cartridge to be loaded in place of the toner cartridge causing the first information or the second information, depending on which is received, the first information or the second information; and outputting an instruction to deliver a replacement toner cartridge of the determined type.

According to a sixth aspect of the present invention, a recording medium has a replacement toner cartridge management program stored thereon to make a computer of an image forming apparatus execute:

detecting first information indicating that a toner cartridge loaded thereon has been replaced with a new one and second information indicating that the remaining amount of toner contained in a toner cartridge loaded thereon reaches a predetermined value;

determining the right type of a replacement toner cartridge to be loaded in place of the toner cartridge causing the first information or the second information, depending on which is received, the first information or the second information; and outputting an instruction to deliver a replacement toner cartridge of the determined type.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which:

FIG. 9 is a view to explain an example of an alert message displayed on an operation panel of the image forming apparatus;

FIG. 10 is a table illustrating the statuses depending on remaining toner level;

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Hereinafter, one mode of implementing the present invention will be described with reference to the accompanying drawings.

Figure 1:
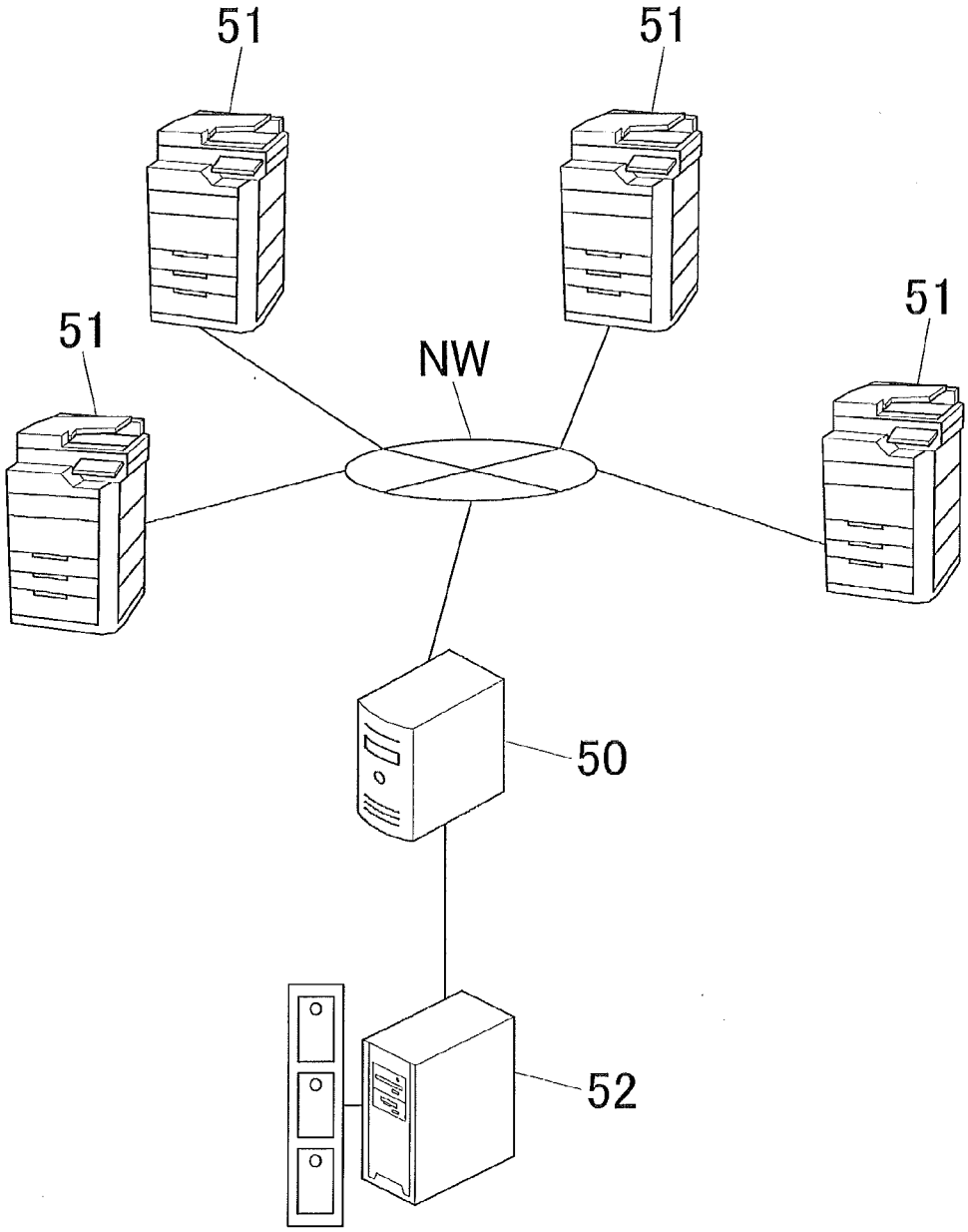
FIG. 1 is a view illustrating a configuration of a replacement toner cartridge management system according to one mode of implementing the present invention.

FIG. 1 is a view schematically illustrating a configuration of a replacement toner cartridge management system according to one mode of implementing the present invention.

As illustrated in FIG. 1, this management system is basically provided with one or more than one image forming apparatus 51 and a management server 50, which are connected to each other via a communication circuit such as Internet. The management server 50 is further connected to an order receiving server 52 via the Internet or the like.

The management server 50 is ordinarily provided in a service center or the like taking care of the image forming apparatuses 51 to manage information of the image forming apparatuses 51 by user accounts. More specifically, by communicating with the image forming apparatuses 51, the management server 50 monitors the remaining toner level(s) of a single toner cartridge or plural toner cartridges containing one color or different colors of toner that is a consumable resource, loaded on the image forming apparatuses 51, and also monitors if there is a replacement toner cartridge(s) for the toner cartridge(s) in stock. That will be further described in detail later. The image management server 50 further manages billing transactions and maintenance issues by collecting billing information such as number of prints and trouble information from the image forming apparatuses 51.

Users may use different types of image forming apparatuses; the image forming apparatuses 51 may be of different types. For example, the image forming apparatuses 51 may be printers, full-color copiers, monochrome copiers, and the like. Therefore, the image forming apparatuses 51 may load four toner cartridges containing four colors of toner: yellow (Y), magenta (M), cyan (C), and black (K), or only one toner cartridge containing one color of toner, black (K).

Furthermore, by monitoring unique uses and use patterns of the users, the management server 50 remotely controls the image forming apparatuses 51 for perfect performance based on settings and the like of the image forming apparatuses 51 stored on its own recording medium. The setting information of the image forming apparatuses 51 is integrally managed by the management server 50; it therefore can be changed by the management server 50 quite easily even if some of the image forming apparatuses 51 are located in remote areas.

The image forming apparatuses 51 and the management server 50 exchange information with each other, for example by e-mails via the Internet network.

Being connected to the order receiving server 52 as described above, the management server 50 can output a delivery instruction to the order receiving server 52, based on toner cartridge replacement information from an image forming apparatus 51, which indicates a toner cartridge has been replaced with a new one, or a notice such as toner near empty information, which indicates that the remaining amount of toner reaches a predetermined value, so that the order receiving server 52 will arrange for the delivery and the user will receive a replacement toner cartridge automatically delivered without the need for placing an order for it.

Figure 2:
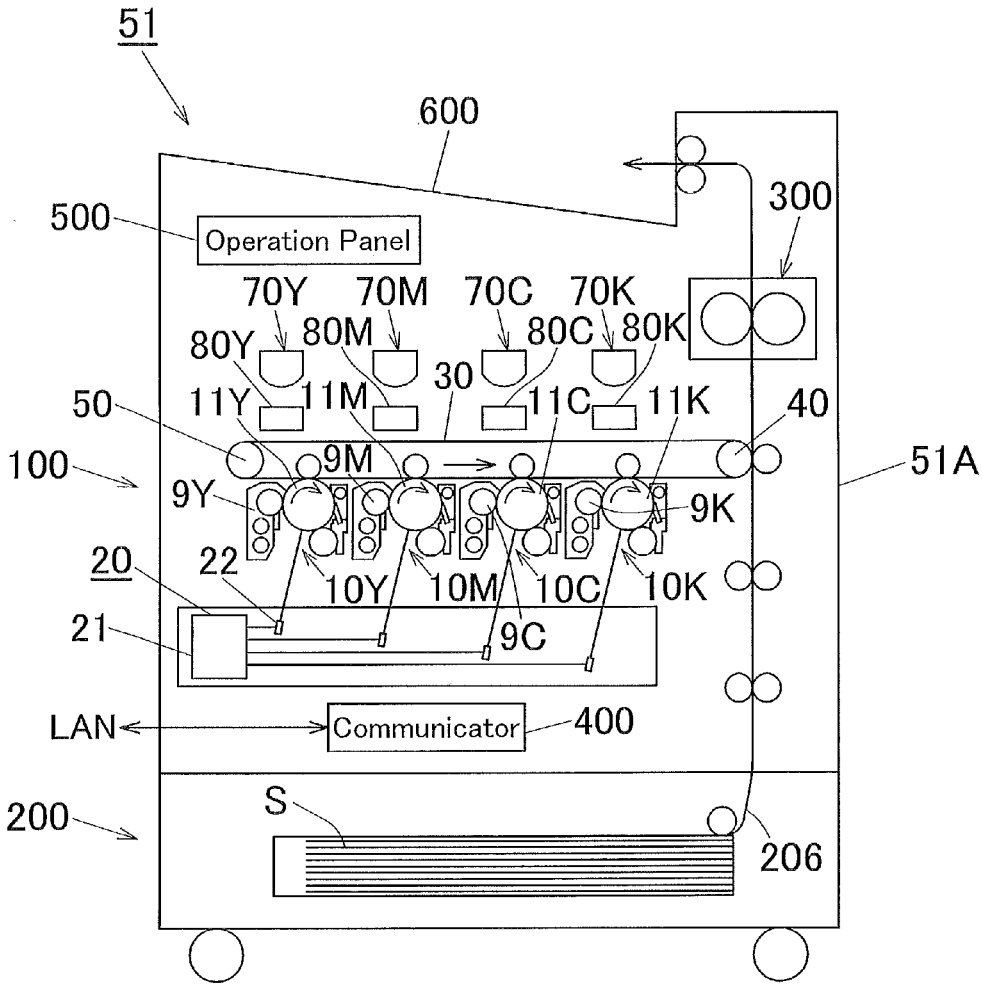
FIG. 2 is a view schematically illustrating a configuration of an image forming apparatus employed in the replacement toner cartridge management system of FIG. 1.

FIG. 2 is a view schematically illustrating a configuration of an image forming apparatus 51. In this example, a tandem color printer is employed as the image forming apparatus 51.

As illustrated in FIG. 1, the image forming apparatus 51 has a paper feeder 200 in the lower area of the body 51A, a color image former 100 in the middle area of the body 51A, and a paper discharger 600 in the upper area of the body 51A, respectively. A paper conveyance path 206 conveying toward the upper area, paper (a sheet of paper) S provided by the paper feeder 200 is extended all the way from the paper feeder 200 to the paper discharger 600.

The color image former 100 includes: a driving roller 40 and a driven roller 50 provided in the middle area of the vertical direction of the body 51A; a midway transfer belt 30 horizontally going around a group of the driving roller 40 and the driven roller 50 to run toward the direction indicated by arrow; and image forming units 10Y, 10M, 10C, and 10K containing yellow (Y), magenta (M), cyan (C), and black (K) of toner, respectively, provided along the belt's running direction.

Toner images formed by the image forming units 10Y, 10M, 10C, and 10K are layered together and transferred onto the transfer belt 30. In the second transfer process, the merged toner images are further transferred on the paper S passing trough the corner of the transfer belt 30 (on the extreme right of the body) via the paper conveyance path 206; the sheet S is conveyed to a fuser 300 to have the merged toner images fixed thereon.

The image forming units 10Y, 10M, 10C, and 10K forming images by the electrostatic copy method is provided with: a charger; a print head 21 including four laser diodes, a polygon mirror, a scanner lens, and the like; an exposure unit 20 including four reflection mirrors 22 and the like; development devices 9Y, 9M, 9C, and 9K; photoreceptor drums 11Y, 11M, 11C, and 11K; a transfer portion; and the like, which are all located in the vicinity of the image forming units themselves.

Above the image forming units 10Y, 10M, 10C, and 10K, toner cartridges 70Y, 70M, 70C, and 70K and sub-hoppers 80Y, 80M, 80C, and 80K are provided as a supplier feature which feeds toner in the development devices 9Y, 9M, 9C, and 9K of the image forming units 10Y, 10M, 10C, and 10K, respectively.

The toner cartridges 70Y, 70M, 70C, and 70K are removably loaded on the body 51A so as to be replaced with new ones when need. The toner cartridges 70Y, 70M, 70C, and 70K have a fuse attached thereto but not illustrated in this drawing; the body 51A detects an unused state of the toner cartridges when their fuses are conductive, and releases the unused state when the fuses are cut out. In other words, cutting the fuses, the toner cartridges are recognized as new ones having been loaded.

In FIG. 1, a portion with the number 400 is a communicator communicating with external machines, and a portion with the number 500 is an operation panel provided with a set of keys and a display.

Figure 3:
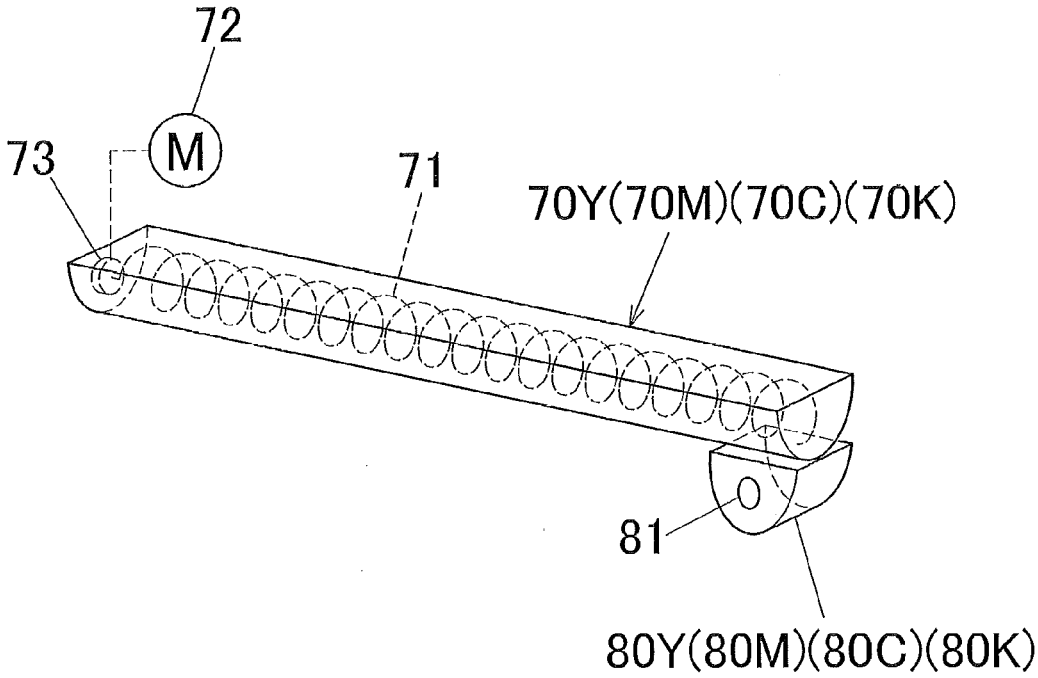
FIG. 3 is a view to explain a feature of the image forming apparatus to feed toner in a sub-hopper from a toner cartridge.

FIG. 3 is a view to explain a feature to feed toner in the sub-hoppers 80Y, 80M, 80C, and 80K from the toner cartridges 70Y, 70M, 70C, and 70K, respectively.

As illustrated in FIG. 3, when the toner cartridges 70Y, 70M, 70C, and 70K are loaded on the body 51A, the sub-hoppers 80Y, 80M, 80C, and 80K open shutters on their top to receive toner from the toner cartridges 70Y, 70M, 70C, and 70K.

The toner cartridge 70Y, 70M, 70C, and 70K have a spiral spring 71 inside, and feed toner in the sub-hoppers 80Y, 80M, 80C, and 80K, respectively, by having their spiral springs 71 rotated by stepper motors (also referred to as cartridge motors) 72.

There provided two stepper motors 72 for the four spiral springs 71; one of the two works for the toner cartridges 70Y and 70M, and the other one works for the toner cartridges 70C and 70K. An even number of gears 73 are arranged between an inlet valve of the toner cartridges 70Y and 70C and an inlet valve for the toner cartridges 70K and 70M; when the stepper motors 72 perform normal rotation, the spiral springs 71 of the toner cartridges 70Y and 70C are properly rotated while the spiral springs 71 of the toner cartridges 70K and 70M are rotated idle, and when the stepper motors 72 perform reverse rotation, the spiral springs 71 of the toner cartridges 70Y and 70C are rotated idle while the spiral springs 71 of the toner cartridges 70K and 70M are properly rotated. Switching the stepper motors 72 between normal rotation and reverse rotation determines whether or not to allow the toner cartridges 70Y, 70M, 70C, and 70K to feed toner.

Figure 4:
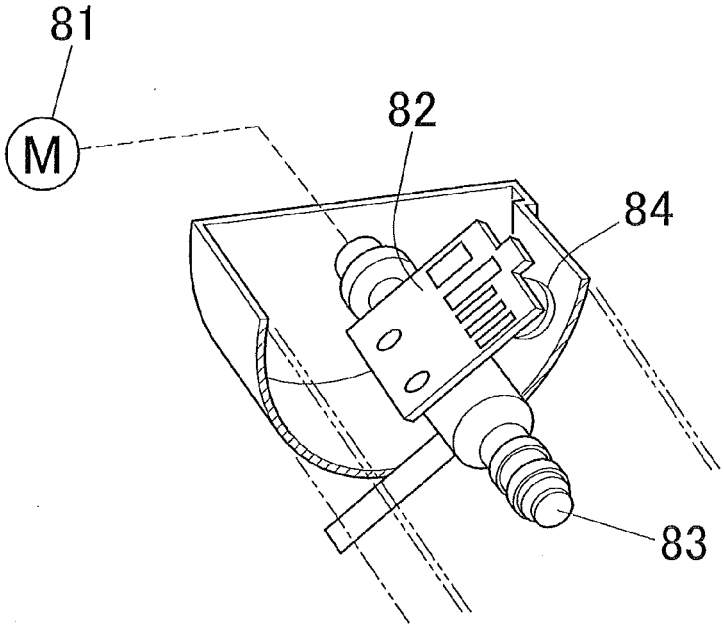
FIG. 4 is a view to explain a feature of the image forming apparatus to feed toner in a development device from the sub-hopper.

FIG. 4 is a view to explain a feature to feed toner in the development devices 9Y, 9M, 9C, and 9K from the sub-hoppers 80Y, 80M, 80C, and 80K.

As illustrated in FIG. 4, there provided one stepper motor (also referred to as sub-hopper motor) 81 for each of the sub-hoppers, the sub-hoppers 80Y, 80M, 80C, and 81K.

The sub-hoppers 80Y, 80M, 80C, and 80K feed toner in the development devices 9Y, 9M, 9C, and 9K, respectively, by having paddles 82 and spiral rollers 83 inside of themselves rotated by the sub-hopper motors 81. The remaining toner levels of the sub-hoppers 80Y, 80M, 80C, and 80K are detected by a toner empty sensor (piezoelectric sensor) 84.

Figure 5:
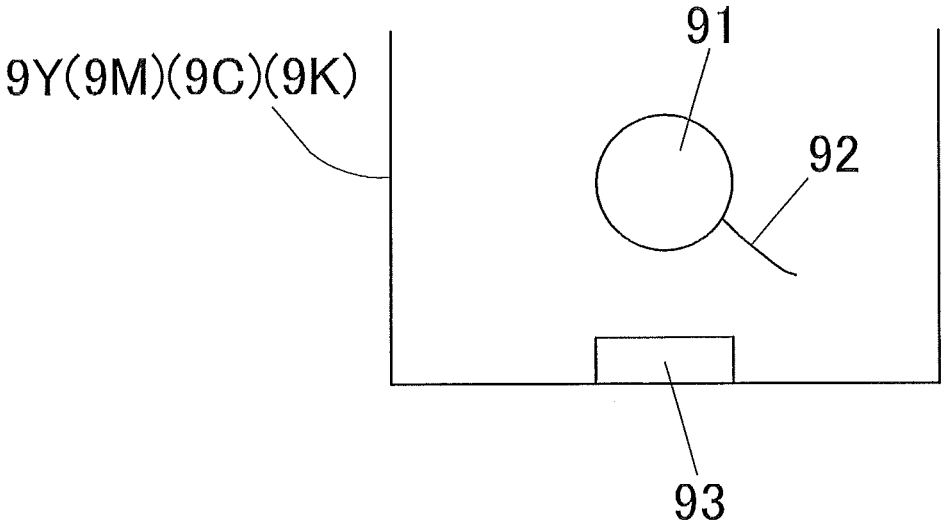
FIG. 5 is a view schematically illustrating a configuration of a feature to measure toner concentration.

FIG. 5 is a view schematically illustrating a configuration of a feature to measure toner concentration.

As illustrated in FIG. 5, the development devices 9Y, 9M, 9C, and 9K is filled with developing agent (toner and carrier); the developing agent in the development devices 9Y, 9M, 9C, and 9K is stirred by a Mylar plastic fin 92 attached to a motor-driven screw agitator 91. While the developing agent in the periphery of a toner concentration sensor 93 provided on the bottom of the development devices 9Y, 9M, 9C, and 9K is stirred by the Mylar plastic fin 92, new developing agent is let in the periphery of the toner concentration sensor 93. In other words, the developing agent in the periphery of the toner concentration sensor 93 is replaced with new one every other turn (ripple) of the screw agitator 91.

The toner concentration sensor 93 is a TCR sensor (magnetic sensor), for example. The toner concentration sensor 93 measures the toner concentration of the developing agent by reading out the magnetic permeability of iron included in the carrier of a unit volume of the developing agent in the periphery of the toner concentration sensor 93. That is, the higher a converted value (10-bit resolution) of an analog signal read out by the toner concentration sensor 93 is, the lower the toner concentration is.

Figure 6:
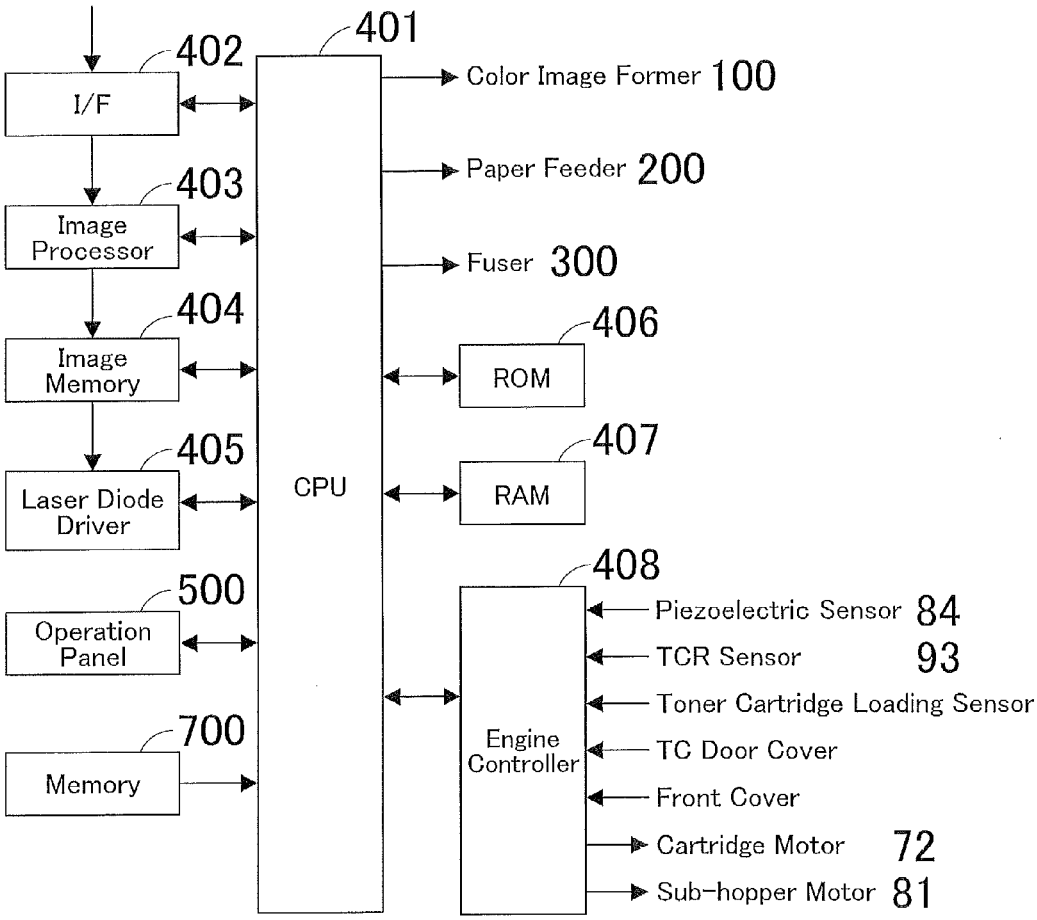
FIG. 6 is a block diagram illustrating a configuration of a controller of the image forming apparatus of FIG. 2.

FIG. 6 is a block diagram illustrating a configuration of a controller of the image forming apparatus 51.

As illustrated in FIG. 6, the controller includes a CPU 401, a communication interface (I/F) 402, an image processor 403, an image memory 404, a laser diode driver 405, an operation panel 500, a recording medium 700, a ROM 406, a RAM 407, and an engine controller 408, as primary members.

The CPU 401 integrally controls all operations of the image forming apparatus 51. Also, the CPU 401 reads out a necessary program from the ROM 406; converts image data by the image processor 403; and writes and reads image data in and out from the image memory 404. Furthermore, the CPU 401 contributes to smooth printing operation by nicely arranging the times of a series of continuous operations of the color image former 100, the paper feeder 200, and the like. Furthermore, the CPU 401 detects (determines) a toner near empty state and an empty state of the toner cartridge 70Y, 70M, 70C, and 70K based on various information inputted from the engine controller 408; arranges the time of detecting (determining) a toner near empty state based on an indicated amount of fed toner and print log data; and displays a predetermined message about the time for replacing the toner cartridges 70Y, 70M, 70C, and 70K, on the operation panel 500. Furthermore, the CPU 401 manages life information of various consumable units such as toner cartridges, a transfer belt unit, a fuser unit, and imaging units such as development units including photoreceptor drums; and transmits the life information to the management server 50 in response to an inquiry from the management server 50.

The communication I/F 402 serves to connect the image forming apparatus 51 to a LAN such as a LAN card or a LAN board, and externally receives data to be printed out according to a print job and transfers it to the image processor 403.

Also, the communication I/F 402 transmits toner empty information, alert information, trouble information, and information of various printing events to the management server 50 managing the image forming apparatus 51 (see FIG. 13) via the Internet, and receives data and an instruction from the administration server 50.

Receiving data to be printed out according to a print job from the communication I/F 402, the image processor 403 converts the data into Y, M, C, and K image data objects for color reproduction and outputs the image data objects to the image memory 404 to have them stored thereon.

Reading out Y, M, C, and K image data objects from the image memory 404, the laser diode driver 405 drives the laser diodes of the exposure unit 20.

The operation panel 500 allows users to perform entry operations and displays various messages for them.

The recording medium 700 stores print log data, toner cartridge replacement log data, and the like, as well as various other data and applications.

The ROM 406 stores programs to control image forming operation and other data such as a table serving for toner supply control, toner empty detection control, and other controls.

The RAM 407 serves as a work area for the CPU 402.

Receiving signals and state information from the toner empty sensor 84, the TCR sensor 93, a toner cartridge loading sensor (not illustrated in the drawing), a TC door sensor (not illustrated in the drawing), a front cover (not illustrated in the drawing), the cartridge motors 72, the sub-hopper motors (not illustrated in the drawing), and the like, the engine controller 408 controls printing operation.

Figure 7:
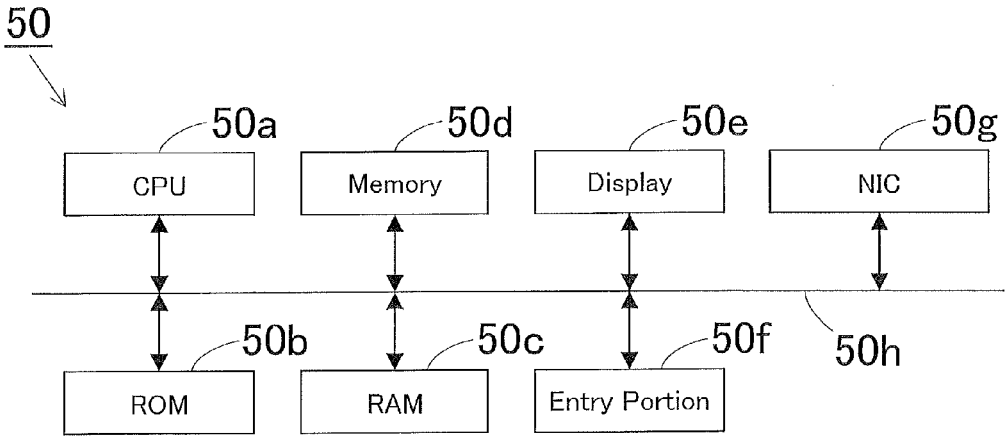
FIG. 7 is a block diagram illustrating a configuration of a toner cartridge management apparatus.

FIG. 7 is a block diagram illustrating a configuration of the management server 50 employed in the toner cartridge management system of FIG. 1.

The management server 50 is provided with a CPU 50*a*, a ROM 50*b*, a RAM 50*c*, a display 50*e*, an entry portion 50*f*, a network interface card (NIC) 50*g*, and the like, which are connected to each other via a system bus 50*h*.

The CPU 50*a* integrally controls the entire management server 50 by executing programs stored on the ROM 50*b*. Specifically, in this mode of embodied implementation, the CPU 50*a* manages information of remaining toner which is a remaining resource contained in the toner cartridges 70Y, 70M, 70C, and 70K loaded on the image forming apparatuses 51; information indicating that the toner cartridges 70Y, 70M, 70C, and 70K have been replaced with new ones; and other information, and updates the information when the need arises. Also, receiving toner cartridge replacement information indicating that the toner cartridge 70Y, 70M, 70C, or 70K has been replaced or toner near empty information indicating that the toner cartridge 70Y, 70M, 70C, or 70K is nearly empty, the CPU 50*a* determines the right type of replacement toner cartridge and outputs a delivery instruction.

The ROM 50*b* is a recording medium that stores programs and data for the CPU 50*a* to execute processing.

The ROM 50*c* is a recording medium that provides a work area for the CPU 50*a* to execute processing according to an operation program.

The recording medium 50*d* is, for example, a hard disk drive, and stores various data, applications, and the like. Specifically, in this mode of embodied implementation, the recording medium 50*d* stores remaining toner information of the toner cartridges 70Y, 70M, 70C, and 70K loaded on the image forming apparatuses 51, which is rewritable thereon. Furthermore, the recording medium 50*d* stores information, for example addresses to which replacement toner cartridges and replacement consumable units will be delivered and used in place of the toner cartridges, the transfer belt unit, the fuser unit, and the development units loaded on the image forming apparatuses 51.

The display 50*e* is, for example, a CRT display or a liquid-crystal display, and displays various messages, entry accepting screens, selection screens, and other screens for administrator-level users and other users.

The entry portion 50*f* serves for administrator-level users and other users to perform entry operation, and includes a keyboard, a mouse, and the like.

The network interface card 50*g* serves as a communicator that exchanges data with the image forming apparatuses 51 and the order receiving server 52 via the Internet network.

Figure 8:
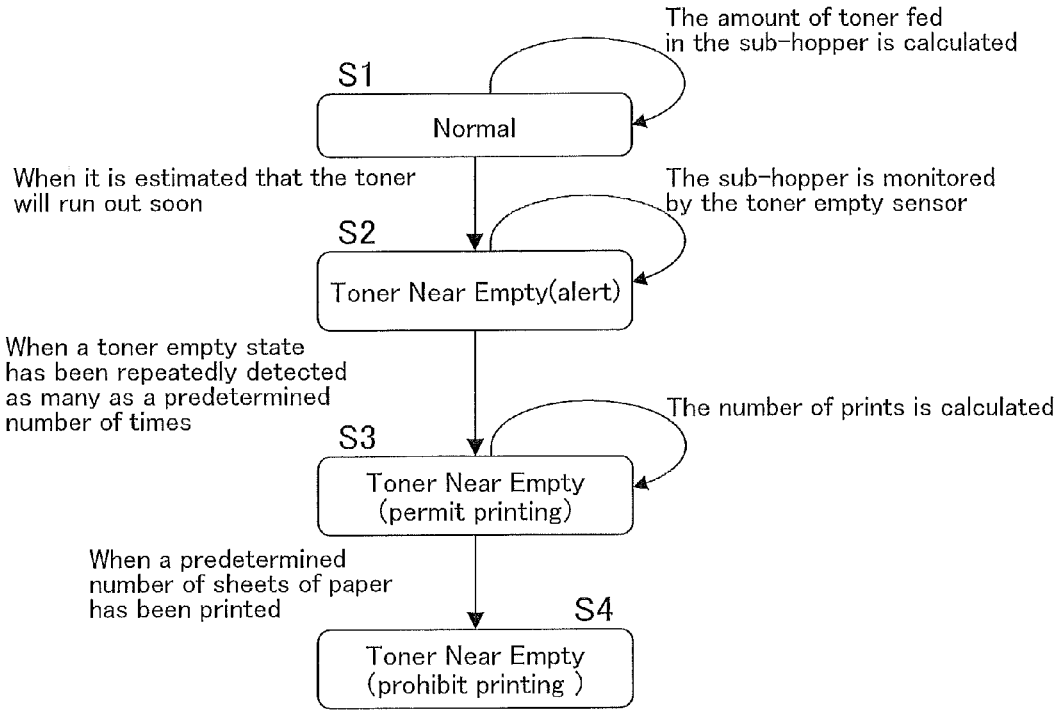
FIG. 8 is a flowchart representing a processing routine to detect a toner empty state.

FIG. 8 is a flowchart representing a processing routine to detect an empty toner cartridge, executed by the image forming apparatuses 51.

In FIG. 8, the remaining toner levels of the toner cartridges 70Y, 70M, 70C, and 70K slowly go down with feeding of toner; the toner cartridges 70Y, 70M, 70C, and 70K eventually run out of toner (become empty).

There are the four states depending on remaining toner level: "normal" (Step S1), "toner near empty (alert)" (Step S2), "toner empty (permit printing)" (Step S3), and "toner empty (prohibit printing)" (Step S4).

Unlike "toner near empty (alert)" (Step S2), "toner empty (permit printing)" (Step S3), and "toner empty (prohibit printing)" (Step S3), "normal" (Step S1) means that the toner cartridges 70Y, 70M, 70C, and 70K and the sub-hoppers 80Y, 80M, 80C, and 80K are sufficiently filled with toner. In these four states including the state of "normal" (Step S1), the CPU 401 accumulates the rotation quantum numbers of the cartridge motors 72, and estimates the amount of toner fed in the sub-hoppers 80Y, 80M, 80C, and 80K based on the rotation quantum numbers.

The CPU 401 determines the state as "toner near empty (alert)" (Step S2) if estimating that the toner cartridges 70Y, 70M, 70C, and 70K nearly run out of toner based on the estimated amount of toner fed in the sub-hoppers 80Y, 80M, 80C, and 80K. In the state of "toner near empty (alert)", as illustrated in FIG. 9, an alert message stating that toner will run out in a short time is displayed on the operation panel 500 so that users will be encouraged to prepare a replacement toner cartridge. After that, thousands of prints still can be made using the toner cartridges 70Y, 70M, 70C and 70K before "toner empty (prohibit printing)" is detected, users therefore have enough time to prepare a replacement toner cartridge even when need to place an order because of no replacement toner cartridges in stock.

The CPU 401 determines the state as "toner empty (permit printing)" (Step S3) when the toner empty sensor 84 has repeatedly detected a toner empty state of the sub-hoppers 80Y, 80M, 80C, and 80K as many as a predetermined number of times. In this state, the toner cartridges 70Y, 70M, 70C, and 70K have no toner left inside while the sub-hoppers 80Y, 80M, 80C, and 80K still contain toner for as many as 100 prints approximately, and printing is therefore permitted.

The CPU 401 determines the state as "toner empty (prohibit printing)" (Step S4) when the sub-hoppers 80Y, 80M, 80C, and 80K run out of toner by further consuming it for a predetermined number of prints after "toner empty (permit printing)" is detected. In this state, printing is prohibited.

In the state of "toner near empty (alert)" (Step S2) and "toner empty (permit printing)" (Step S3), as illustrated in FIG. 9, an alert message is displayed on the operation panel 500 to let the user know that the toner will run out soon. In the state of "toner empty (prohibit printing)" (Step S4), a strong alert message is displayed on the operation panel 500 to let the user know that the toner has run out, and printing is prohibited.

These states depending on remaining toner level: normal, toner near empty, toner empty (permit printing), and toner empty (prohibit printing) (described in Steps S1 to S4, respectively) are incorporated in a table illustrated in FIG. 10.

As is obviously understood from the table of FIG. 10, when the state turns to "toner empty (permit printing)" (Step S3), it is acceptable to replace the toner cartridges 70Y, 70M, 70C, and 70K with new ones since these contain little remaining toner (almost run out of toner); when the state turns to "toner near empty" (Step S2), it is not preferred to replace the toner cartridges 70Y, 70M, 70C, and 70K with new ones since these still contain some remaining toner.

Figure 11:
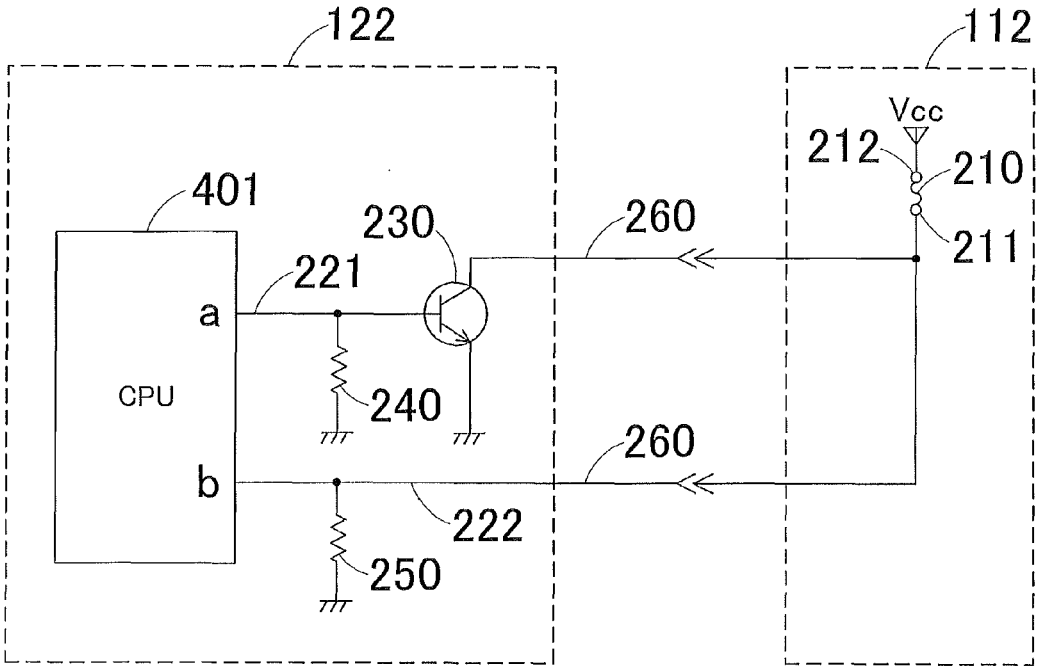
FIG. 11 is a view illustrating a specific example of a configuration of a new toner cartridge detection feature.

FIG. 11 is a view illustrating a specific example of a configuration of a new toner cartridge detection feature.

As illustrated in FIG. 11, a toner cartridge state transmitter 112 is provided with a fuse 210. Meanwhile, a cartridge state controller (the body of an image forming apparatus 51) 122 is provided with a CPU 401, a transistor 230, and pull-down resistors 240 and 250. When a toner cartridge 110 is set at a predetermined position of the body of the image forming apparatus 51, the toner cartridge state transmitter 112 and a cartridge state controller 122 are connected to each other via a connector 260.

As illustrated in FIG. 11: an output terminal a of the CPU 401 is connected to a base terminal of the transistor 230; a collector terminal of the transistor 230 is connected to a terminal 211 of the fuse 210 via the connector 260; and an emitter terminal of the transistor 230 is connected to earth ground. Supply voltage Vcc is applied to the other terminal 212 of the fuse 210, from the image forming apparatus 51. The terminal 211 of the fuse 210 is further connected to an input terminal b of the CPU 401, via the connector 260. A terminal of the pull-down resistor 240 is connected to a signal line 221 which connects the output terminal a of the CPU 401 and the base terminal of the transistor 230 to each other; the other terminal of the pull-down resistor 240 is connected to earth ground. A terminal of the pull-down resistor 250 is connected to a signal line 222 which connects the input terminal b of the CPU 401 and the terminal 211 of the fuse 210 via the connector 260; the other terminal of the pull-down resistor 250 is connected to earth ground.

As long as the toner cartridge 110 is full and new, the fuse 210 is in a short circuit state. Therefore, Vcc is inputted to the input terminal b of the CPU 401 via the connector 260 and the signal line 222. After setting the toner cartridge 110 on the body of the image forming apparatus 51, the CPU 401 outputs an H (high) level of signals from its output terminal to the transistor 230 to turn it ON, which causes the phenomenon as if the terminal 211 of the fuse 210 is connected to earth ground. As a result, the fuse 210 is subjected to more than a regular volume of electrical current, and is meltdown; the fuse 210 is no more in a short circuit state, and is now in a patulous state. When the fuse 210 becomes patulous, GND is inputted to the input terminal b of the CPU 401 via the pull-down resistor 250. With the circuit construction described above, the CPU 401 judges the state of the toner cartridge 110 (for example, whether or not it is full and new) based on the voltage of signals which are inputted to the input terminal b, and further controls the state of the toner cartridge 110 which is provided by the toner cartridge state transmitter 112.

Figure 12:
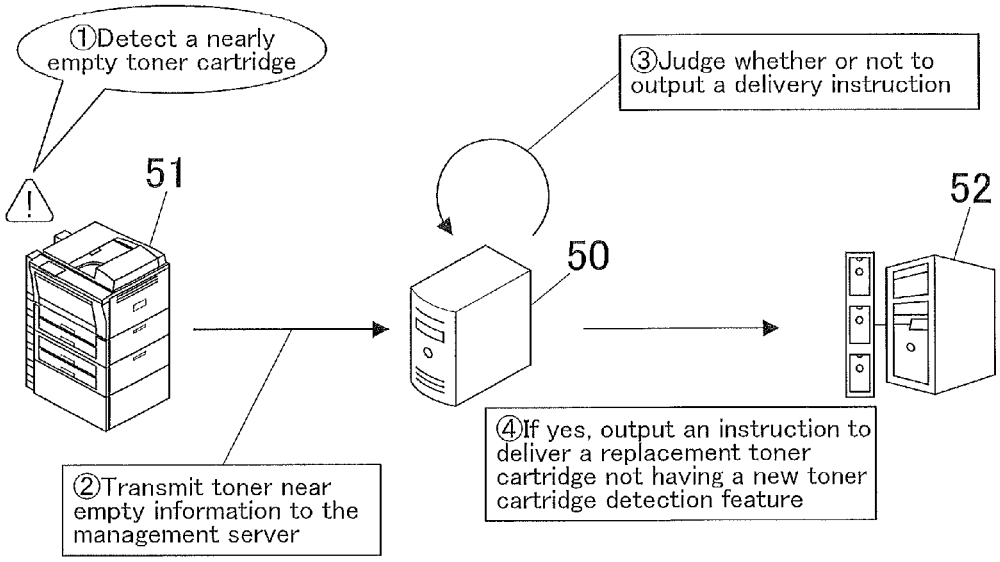
FIG. 12 is a view to explain the overview of a procedure executed by the replacement toner cartridge management system to determine the right type of replacement toner cartridge and output a delivery instruction.

FIG. 12 is a view to explain the overview of a procedure to determine the right type of replacement toner cartridge for the toner cartridges 70Y, 70M, 70C, and 70K and output a delivery instruction, in the toner cartridge management system according to this mode of embodied implementation.

In this example, receiving from an image forming apparatus 51, information indicating that the toner cartridge 70Y, 70M, 70C, or 70M is nearly empty, the management server 50 outputs an instruction to deliver a replacement toner cartridge.

To begin with, a toner cartridge loaded on an image forming apparatus 51 becomes nearly empty (circled number 1). Then the image forming apparatus 51 transmits toner near empty information to the management server 50 connected therewith via a communication circuit (circled number 2). As is previously mentioned, the image forming apparatus 51 detects a toner near empty state of a toner cartridge by measuring the amount of toner fed into the toner cartridge. The management server 50 judges whether or not a delivery instruction should be outputted, and if it should be outputted, the management server 50 determines a replacement toner cartridge which contains the same color of toner as the nearly empty toner cartridge and is reasonably priced because of not having a new toner cartridge detection feature (not having a fuse attached thereto) (circled number 3). And the management server 50 outputs an instruction to deliver such a replacement toner cartridge to the order receiving server 52 (circled number 4).

Figure 13:
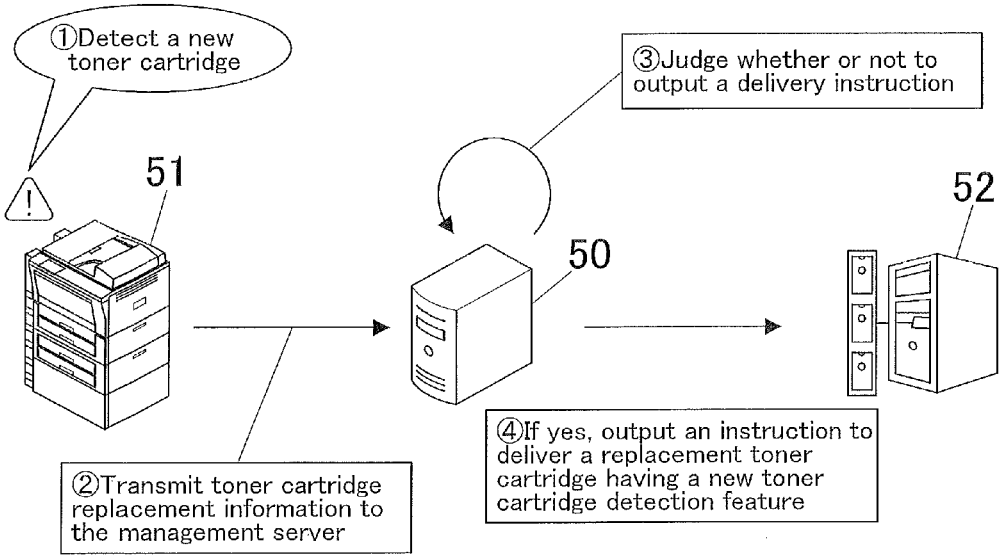
FIG. 13 is a view to explain the overview of a procedure executed by the replacement toner cartridge management system to determine the right type of replacement toner cartridge and output a delivery instruction.

FIG. 13 is a view to explain the overview of a procedure to determine the right type of replacement toner cartridge and output a delivery instruction, in the replacement toner cartridge management system according to this mode of embodied implementation.

In this example, receiving from an image forming apparatus 51, toner cartridge replacement information indicating that the toner cartridge 70Y, 70M, 70C, or 70M has been replaced with a new one, the management server 50 outputs an instruction to deliver a replacement toner cartridge.

As is previously mentioned, an image forming apparatus 51 detects if the toner cartridges 70Y, 70M, 70C, and 70K has been replaced with new ones, depending on the fuses attached to new toner cartridge 70Y, 70M, 70C, and 70K. When the fuses are conductive, an image forming apparatus 51 detects a detection signal indicating "new toner cartridge"; when the fuses are cut out, it detects a detection signal indicating "old toner cartridge".

To begin with, a toner cartridge loaded on an image forming apparatus 51 is replaced with a new one (circled number 1). Then the image forming apparatus 51 transmits the toner cartridge replacement information to the management server 51 connected therewith via a communication circuit (circled number 2). The management server 50 judges whether or not a delivery instruction should be outputted, and if it should be outputted, the management server 50 determines a replacement toner cartridge which contains the same color of toner as the new toner cartridge most recently loaded and has a new toner cartridge detection feature (has a fuse attached thereto) (circled number 3). And the management server 50 outputs an instruction to deliver such a replacement toner cartridge to the order receiving server 52 (circled number 4).

Figure 14:
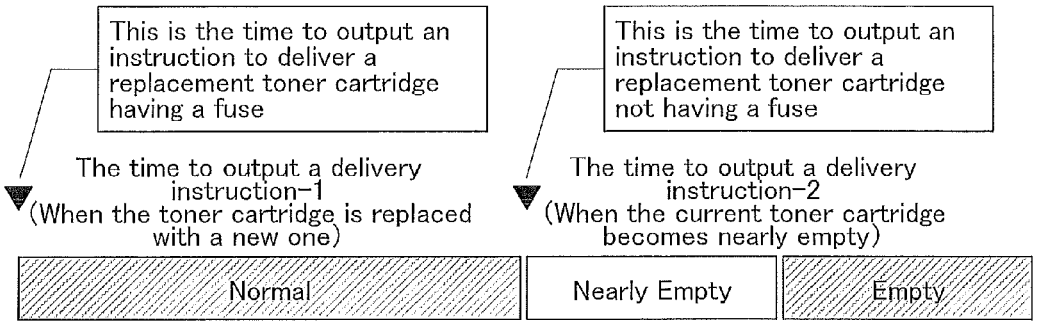
FIG. 14 is a view to further explain the procedures explained with reference to FIGS. 12 and 13, based on the state of the remaining amount of toner.

FIG. 14 is a view to further explain the procedures explained with reference to FIGS. 12 and 13, based on the state of the remaining amount of toner.

Receiving information indicating that a toner cartridge has been replaced with a new one, at the time indicated by circled number 1 in FIG. 14, the management server 50 determines a replacement toner cartridge having a new toner cartridge detection feature (having a fuse attached thereto) and outputs an instruction to deliver such a replacement toner cartridge; receiving information indicating that a toner cartridge is nearly empty, at the time indicated by circled number 2 in FIG. 14, the management server 50 determines a replacement toner cartridge not having a new toner cartridge detection feature (not having a fuse attached thereto) and outputs an instruction to deliver such a replacement toner cartridge. In this Figure, "Toner in Normal State" means that the currently loaded toner cartridge contains a sufficient amount of toner.

Figure 15:
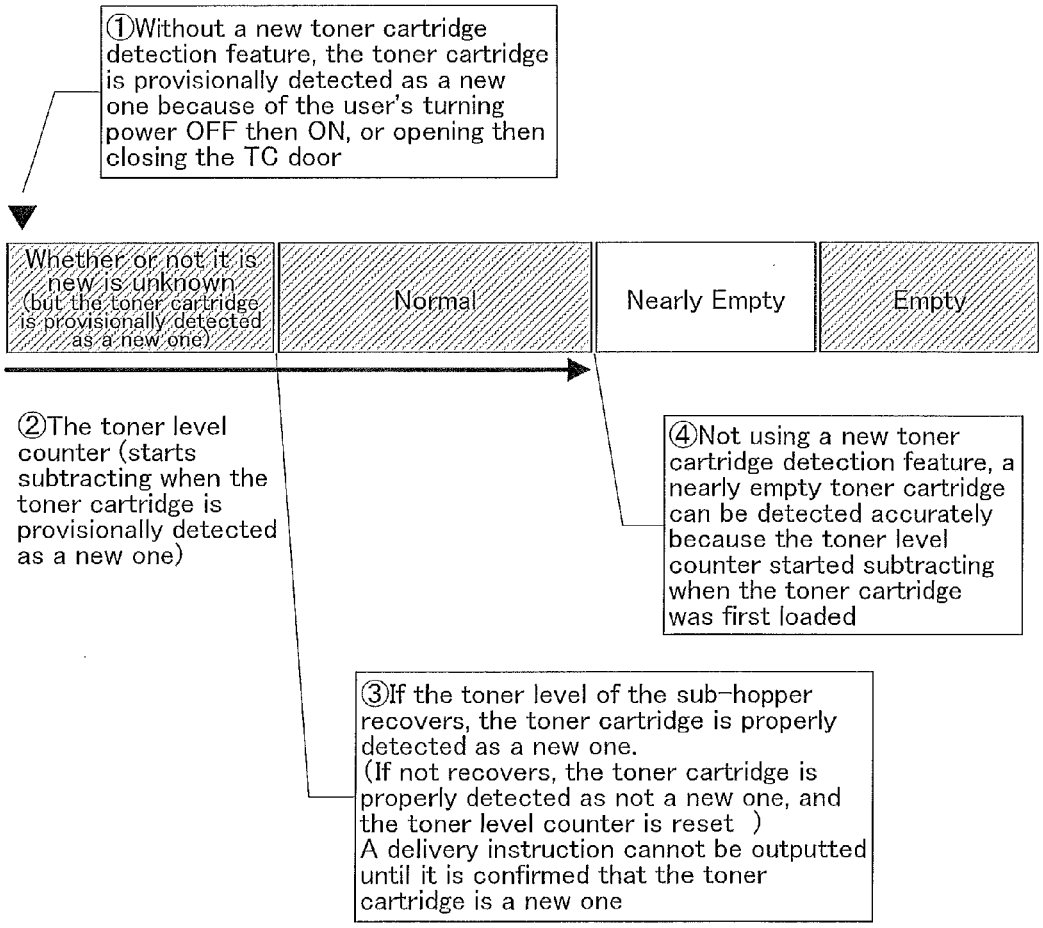
FIG. 15 is a view to explain that when a toner cartridge loaded on an image forming apparatus is replaced with a new toner cartridge not having a new toner cartridge detection feature, the image forming apparatus cannot quickly detect it as a new one, but can accurately detect it as nearly empty.

FIG. 15 is a view to explain that when a toner cartridge loaded on an image forming apparatus is replaced with a replacement toner cartridge not having a new toner cartridge detection feature, the image forming apparatus cannot quickly detect it as a new one, but can accurately detect it as nearly empty;

A user replaces an empty toner cartridge (with an empty sub-hopper) loaded on an image forming apparatus 51, with a new one. By detecting user operations which are supposed to lead to toner cartridge replacement, such as turning power OFF then ON, or opening then closing the door to access the toner cartridges, the image forming apparatus 51 provisionally detects a new toner cartridge having been loaded thereon. Not using a new toner cartridge detection feature, the image forming apparatus 51 may happen to detect it by error, as a matter of course. However, the explanation will be continued as the following by way of experiment, with this image forming apparatus 51 as is. Detecting a new toner cartridge having been loaded thereon, the image forming apparatus 51 allows a toner level counter to start subtracting. The toner level counter estimates the toner level by accumulating the rotating time of the motor for toner supply.

With the start of a print operation, the new toner cartridge is allowed to feed toner to the sub-hopper. If detecting a recovery in the toner level of the sub-hopper, the image forming apparatus 51 confirms that what was provisionally detected is true. If not detecting a recovery in the toner level of the sub-hopper, the image forming apparatus 51 resets the toner level counter, confirming no new toner cartridge having been loaded thereon.

Briefly, in this example, even when a toner cartridge is actually replaced with a new one, the image forming apparatus 51 will not output an instruction to deliver a replacement toner cartridge until confirming that it is true. Users who wish to have a replacement toner cartridge always in stock so that it is available immediately when they need, basically require the management server 50 to output a delivery instruction when a toner cartridge is replaced with a new one. Therefore, the delay of outputting a delivery instruction may cause the inconvenience that they cannot replace an empty toner cartridge because of no replacement toner cartridge in stock, which is against their original requirement.

On the other hand, the image forming apparatus 51 detects a nearly empty toner cartridge if the toner level counter reaches a predetermined value. Not using a new toner cartridge detection feature, the image forming apparatus 51 can accurately detect a nearly empty toner cartridge because the toner level counter started subtracting when the toner cartridge was first loaded thereon.

As described above, when a toner cartridge is replaced with a new toner cartridge not having a new toner cartridge detection feature, the image forming apparatus 51 cannot quickly detect it as a new one, meanwhile when a toner cartridge not having a new toner cartridge detection feature is nearly empty, the image forming apparatus 51 can accurately detect it as nearly empty.

Figure 16:
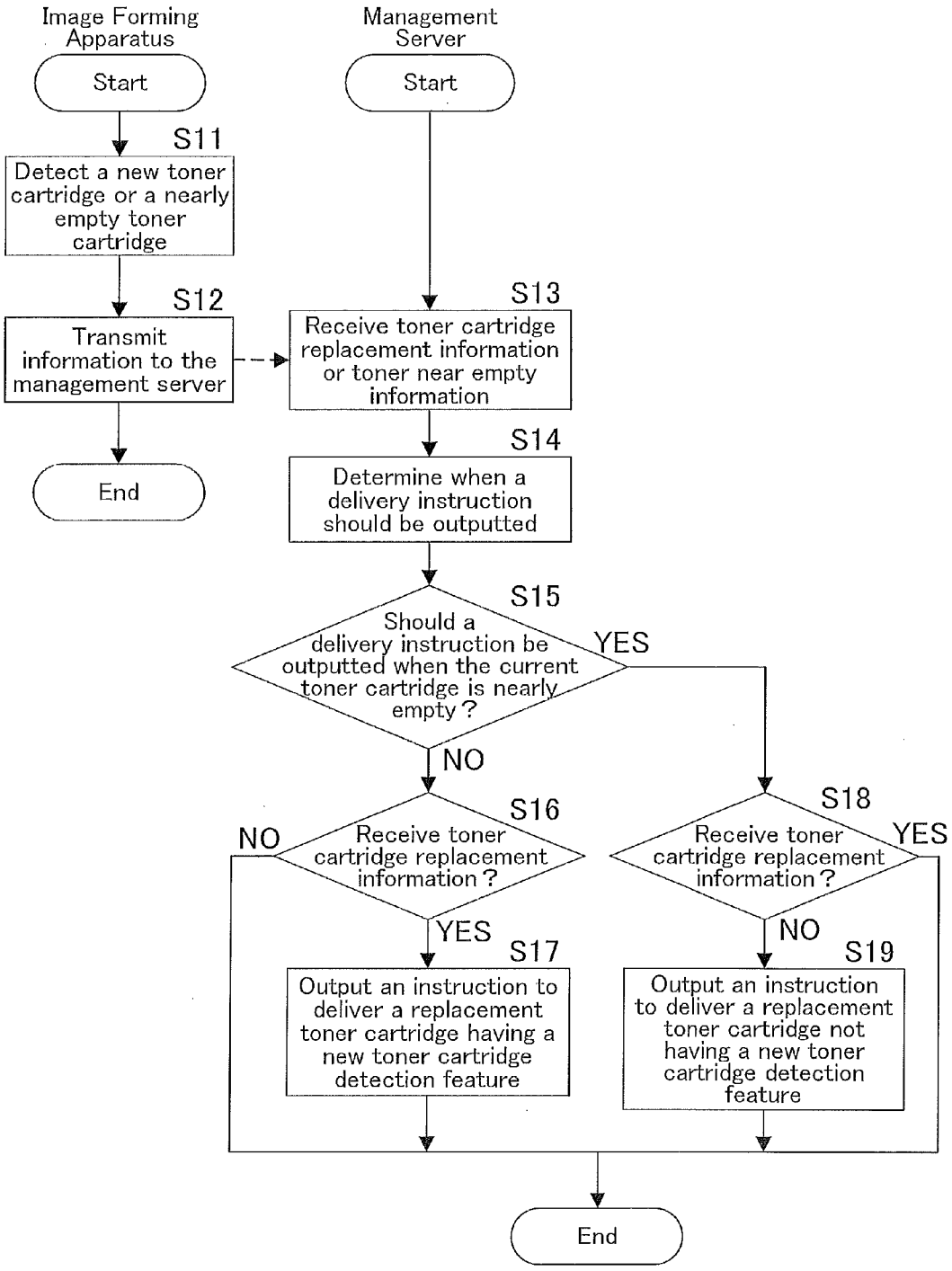
FIG. 16 is a flowchart representing a processing routine executed by the management server to determine the right type of replacement toner cartridge and output an order, starting when an image forming apparatus detects a new toner cartridge having been loaded thereon or a nearly empty toner cartridge.

FIG. 16 is a flowchart representing a processing routine executed by the management server 50 to determine the right type of replacement toner cartridge and output an order, starting when an image forming apparatus 51 detects a new toner cartridge having been loaded thereon or a nearly empty toner cartridge. The processing routine is executed by the CPU 50*a* of the management server 50 according to an operation program stored on a recording medium such as the ROM 50*b*.

In Step S11, an image forming apparatus 51 detects a new toner cartridge having been loaded thereon or a nearly empty toner cartridge, and then in Step S12, the image forming apparatus 51 transmits the toner cartridge replacement information or the toner near empty information to the management server 50.

Receiving the information in Step S13, the management server 50 determines either when a toner cartridge is replaced with a new one or when a toner cartridge is nearly empty, at which time a delivery instruction should be outputted, in Step S14. The management server 50 may arrive at a conclusion as described below.

For example, users perform setting in advance on the management server 50 to specify the option "when a toner cartridge is replaced with a new one" or "when a toner cartridge is nearly empty" about the respective image forming apparatuses 51, and the management server 50 follows the setting. A user who wishes to have a replacement toner cartridge always in stock specifies the option "when a toner cartridge is replaced with a new one", meanwhile a user who does not wish to have a replacement toner cartridge always in stock specifies the option "when a toner cartridge is nearly empty".

Or alternatively, the management server 50 may automatically switch between the options depending on the time of receiving the toner cartridge replacement information or the toner near empty information from the image forming apparatus 51.

Back to the routine, based on the determination result obtained in Step S14, the management server 50 judges whether or not the specified option is "when a toner cartridge is nearly empty". If it is "when a toner cartridge is nearly empty", i.e. it is not "when a toner cartridge is replaced with a new one" (NO in Step S15), the routine proceeds to Step S16. If it is "when a toner cartridge is nearly empty" (YES in Step S15), the routine proceeds to Step S18.

In Step S16, the management server 50 judges whether or not the information received in Step S13 is the toner cartridge replacement information. If it is the toner cartridge replacement information (YES in Step S16), the management server 50 outputs an instruction to deliver a replacement toner cartridge having a new toner cartridge detection feature to the order receiving server 52, in Step S17. If it is not the toner cartridge replacement information (NO in Step S16), the routine terminates.

Meanwhile, in Step S18, the management server 50 judges whether or not the information received in Step S13 is the toner cartridge replacement information. If it is the toner near empty information (NO in Step S18), the management server 50 outputs an instruction to deliver a replacement toner cartridge not having a new toner cartridge detection feature to the order receiving server 52, in Step S19. If it is the toner cartridge replacement information (YES in Step S18), the routine terminates.

As described above, in this mode of embodied implementation, users who wish to have a replacement toner cartridge always in stock basically require the management server 50 to output a delivery instruction when a toner cartridge is replaced with a new one; in order to meet their needs, the management server 50 determines a replacement toner cartridge having a new toner cartridge detection feature with which the image forming apparatus 51 can properly detect it as a new one, and outputs a delivery instruction. Meanwhile, users who do not wish to have a replacement toner cartridge always in stock basically require the management server 50 to output a delivery instruction when a toner cartridge is nearly empty; in order to meet their needs, the management server 50 determines a replacement toner cartridge not having a new toner cartridge detection feature with which the image forming apparatus 51 does not have to detect it as a new one anymore, and outputs a delivery instruction. Therefore, the costs of toner cartridges can be saved without a new toner cartridge detection feature.

Figure 17:
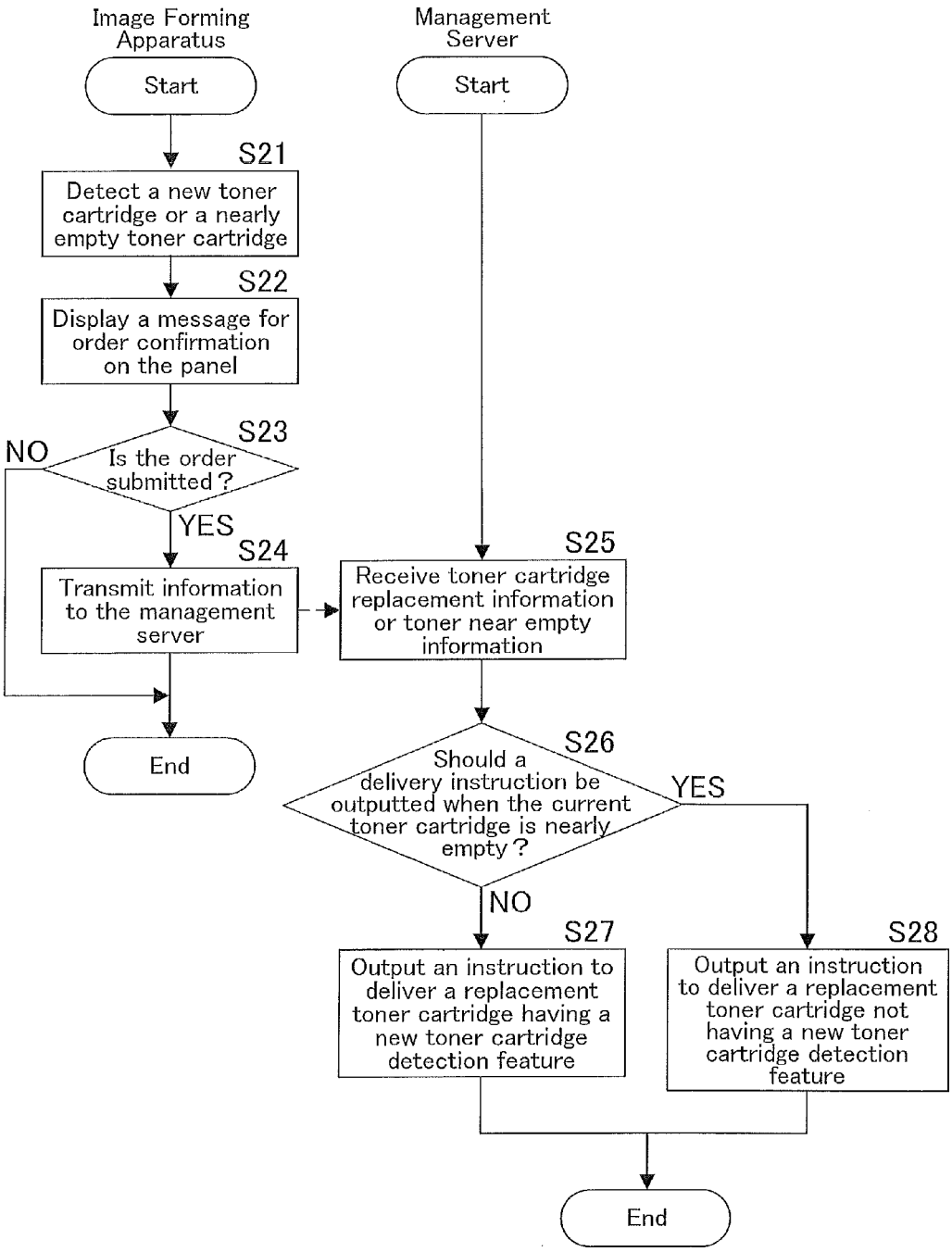
FIG. 17 illustrates another mode of implementing the present invention, and is another flowchart representing a processing routine executed by the management server to determine the right type of replacement toner cartridge and output an order, starting when an image forming apparatus detects a new toner cartridge having been loaded thereon or a nearly empty toner cartridge.

FIG. 17 is a flowchart representing a processing routine executed by the management server 50 to determine the right type of replacement toner cartridge and output an order, starting when an image forming apparatus 51 detects a new toner cartridge having been loaded thereon or a nearly empty toner cartridge. The processing routine is executed by the CPU 50*a* of the management server 50 according to an operation program stored on a recording medium such as the ROM 50*b*.

In Step S21, an image forming apparatus 51 detects a new toner cartridge having been loaded thereon or a nearly empty toner cartridge, and then in Step S22, the image forming apparatus 51 displays a message inquiring if the user wishes to submit an order for a replacement toner cartridge, along with an "YES" button and a "NO" button on the operation panel 500.

Subsequently, it is judged whether or not the user wishes to submit an order for a replacement toner cartridge, i.e. the user pressed the "YES" button in Step S23. If he/she wishes to submit an order (YES in Step S23), the image forming apparatus 51 transmits the toner cartridge replacement information or the toner near empty information to the management server 50 in Step S24. If he/she does not wish to submit an order (NO in Step S23), the routine immediately terminates.

Receiving the information in Step S25, the management server 50 determines whether or not a delivery instruction should be outputted when a toner cartridge is nearly empty, based on the information received from the image forming apparatus 51, in Step S26. If a delivery instruction should be outputted when a toner cartridge is replaced with a new one (NO in Step S26), the management server 50 outputs an instruction to deliver a replacement toner cartridge having a new toner cartridge detection feature to the order receiving server 52, in Step S27. If a delivery instruction should be outputted when a toner cartridge is nearly empty (YES in Step S26), the management server 50 outputs an instruction to deliver a replacement toner cartridge not having a new toner cartridge detection feature to the order receiving server 52, in Step S28.

As described above, in this mode of embodied implementation, the image forming apparatus 51 displays a message to confirm an order for a replacement toner cartridge, on the operation panel 500, and outputs a delivery instruction after the user submits his/her order. Therefore, possible trouble with users over order confirmation can be prevented.

The modes of implementing the present invention have been described in the foregoing specification, which does not mean that the present invention shall be construed as limited to the particular forms disclosed. For example, every toner cartridge uses a fuse as a new cartridge detection feature in the modes of implementation. Alternatively, every toner cartridge may use a memory chip or the like having information indicating whether or not it is new which is written thereon, as a new cartridge detection feature.

Furthermore, in the modes of embodied implementation, the management server 50, not any of the image forming apparatuses 51, serves to: receive toner cartridge replacement information and toner near empty information; determine the right type of replacement toner cartridge; and output a delivery instruction (output an order). Alternatively, taking over all these functions of the management server 50, one of the image forming apparatuses 51 may serve to: receive toner cartridge replacement information and toner near empty information; determine the right type of replacement toner cartridge; and output a delivery instruction (output an order). In this case, the operations described above are performed according to an operation program by the control of the CPU 401 of the image forming apparatus 51.

Furthermore, in the modes of embodied implementation, there is the order receiving server 52 and the management server 50 outputs a delivery instruction to the order receiving server 52. Alternatively, the management server 50 may output a message encouraging the users to place an order: on the display 50*e* of the management server 50 itself; on a display of another machine such as a personal computer; or on a display of the operation panel 500 of one of the image forming apparatuses 51 if it takes over the functions of the management server 50. In this case, an order placement operation is manually performed. In such a case, an order placement operation is manually performed.

An image forming apparatus 51 may be an inkjet image forming apparatus.

Each of the following is one aspect of the present invention of the subject application having been described above: a replacement toner cartridge management apparatus which is capable of contributing to the saving on the costs of toner cartridges by delivering a replacement toner cartridge not having a new toner cartridge detection feature according to the user needs; a replacement toner cartridge management system; an image forming apparatus; a replacement toner cartridge management method; and recording mediums.

[1] A replacement toner cartridge management apparatus is provided with:

a receiver which receives first information indicating that a toner cartridge has been replaced with a new one and second information indicating that the remaining amount of toner contained in a toner cartridge reaches a predetermined value, from one or more than one image forming apparatus which the replacement toner cartridge management apparatus can access via a communication circuit;

a determiner which determines the right type of a replacement toner cartridge to be loaded in place of the toner cartridge causing the first information or the second information, depending on which is received by the receiver, the first information or the second information; and a transmitter which outputs an instruction to deliver a replacement toner cartridge of the type determined by the determiner.

[2] The replacement toner cartridge management apparatus as recited in the aforementioned item [1], wherein:

the type of replacement toner cartridge determined by the determiner is provided with or not provided with a new toner cartridge detection feature; and if the first information is received by the receiver, the determiner makes a first determination that a replacement toner cartridge provided with a new toner cartridge detection feature should be delivered, or if the second information is received by the receiver, the determiner makes a second determination that a replacement toner cartridge not provided with a new toner cartridge detection feature.

[3] The replacement toner cartridge management apparatus as recited in the aforementioned item [1], wherein the second information indicates a toner cartridge is nearly empty.

[4] The replacement toner cartridge management apparatus as recited in the aforementioned item [1], wherein if a delivery instruction given by a user is received by the receiver along with the first information or the second information from the image forming apparatus, the determiner makes the first determination or the second determination.

[5] The replacement toner cartridge management apparatus as recited in the aforementioned item [1], wherein the transmitter outputs the delivery instruction to an order receiving server for handling consumables order transactions which the replacement toner cartridge management apparatus can access via a communication circuit.

[6] An image forming apparatus is provided with:

a detector which detects first information indicating that a toner cartridge loaded thereon has been replaced with a new one and second information indicating that the remaining amount of toner contained in a toner cartridge loaded thereon reaches a predetermined value;

a determiner which determines the right type of a replacement toner cartridge to be loaded in place of the toner cartridge causing the first information or the second information, depending on which is detected by the detector the first information or the second information; and a transmitter which outputs an instruction to deliver a replacement toner cartridge of the type determined by the determiner.

[7] The image forming apparatus as recited in the aforementioned item [6], wherein:

the type of replacement toner cartridge determined by the determiner is provided with or not provided with a new toner cartridge detection feature; and if the first information is detected by the detector, the determiner makes a first determination that a replacement toner cartridge provided with a new toner cartridge detection feature should be delivered, or if the second information is detected by the detector, the determiner makes a second determination that a replacement toner cartridge not provided with a new toner cartridge detection feature.

[8] The image forming apparatus as recited in the aforementioned item [6], wherein the second information indicates that a toner cartridge is nearly empty.

[9] The image forming apparatus as recited in the aforementioned item [6], further provided with a display, wherein:

if the first information or the second information is detected by the detector, an order placement button is displayed on the display; and if the order placement button is pressed by a user, the determiner makes the first determination or the second determination.

[10] The image forming apparatus as recited in the aforementioned item [6], wherein the transmitter outputs the delivery instruction to an order receiving server for handling consumables order transactions which the replacement toner cartridge management apparatus can access via a communication circuit.

[11] A replacement toner cartridge management system provided with one or more than one image forming apparatus having one or more than one toner cartridge loaded thereon and a management server which can access each other via a communication circuit, wherein:

the image forming apparatus is provided with a transmitter which transmits first information indicating that a toner cartridge has been replaced with a new one and second information indicating that the remaining amount of toner contained in a toner cartridge reaches a predetermined value; and the management apparatus is provided with:

a receiver which receives the first information and the second information;

a determiner which determines the right type of a replacement toner cartridge to be loaded in place of the toner cartridge causing the first information or the second information, depending on which is received by the receiver, the first information or the second information; and a transmitter which outputs an instruction to deliver a replacement toner cartridge of the type determined by the determiner.

[12] The replacement toner cartridge management apparatus as recited in the aforementioned item [11], wherein:

the type of replacement toner cartridge determined by the determiner of the management apparatus is provided with or not provided with a new toner cartridge detection feature; and if the first information is received by the receiver of the management apparatus, the determiner of the management apparatus makes a first determination that a replacement toner cartridge provided with a new toner cartridge detection feature should be delivered, or if the second information is received by the receiver of the management apparatus, the determiner of the management apparatus makes a second determination that a replacement toner cartridge not provided with a new toner cartridge detection feature.

[13] The replacement toner cartridge management system as recited in the aforementioned item [11], wherein the second information indicates that a toner cartridge is nearly empty.

[14] The replacement toner cartridge management system as recited in the aforementioned item [11], wherein:

the image forming apparatus is further provided with a display;

if an order placement button displayed on the display is pressed by a user, the transmitter of the image forming apparatus outputs a delivery instruction along with the first information or the second information; and if the delivery instruction is received by the receiver of the management apparatus along with the first information or the second information from the image forming apparatus, the determiner of the management apparatus makes the first determination or the second information.

[15] The replacement toner cartridge management system as recited in the aforementioned item [11], wherein the transmitter of the management apparatus outputs the delivery instruction to an order receiving server for handling consumables order transactions which the replacement toner cartridge management apparatus can access via a communication circuit.

[16] A replacement toner cartridge management method implemented by a replacement toner cartridge management system provided with one or more than one image forming apparatus having one or more than one toner cartridge loaded thereon, and a management apparatus which can access each other via a communication circuit, including:

the image forming apparatus's transmitting first information indicating that a toner cartridge has been replaced with a new one and second information indicating that the remaining amount of toner contained in a toner cartridge reaches a predetermined value; and the management apparatus's:

receiving the first information and the second information;

determining the right type of a replacement toner cartridge to be loaded in place of the toner cartridge causing the first information or the second information, depending on which is received, the first information or the second information; and outputting an instruction to deliver a replacement toner cartridge of the determined type.

[17] A non-transitory computer-readable recording medium having a replacement toner cartridge management program stored thereon to make a computer of a replacement toner cartridge management apparatus execute:

receiving first information indicating that a toner cartridge has been replaced with a new one and second information indicating that the remaining amount of toner contained in a toner cartridge reaches a predetermined value, from one or more than one image forming apparatus which the replacement toner cartridge management apparatus can access via a communication circuit;

determining the right type of a replacement toner cartridge to be loaded in place of the toner cartridge causing the first information or the second information, depending on which is received, the first information or the second information; and outputting an instruction to deliver a replacement toner cartridge of the determined type.

[18] A non-transitory computer-readable recording medium having a replacement toner cartridge management program stored thereon to make a computer of an image forming apparatus execute:

detecting first information indicating that a toner cartridge loaded thereon has been replaced with a new one and second information indicating that the remaining amount of toner contained in a toner cartridge loaded thereon reaches a predetermined value;

determining the right type of a replacement toner cartridge to be loaded in place of the toner cartridge causing the first information or the second information, depending on which is received, the first information or the second information; and outputting an instruction to deliver a replacement toner cartridge of the determined type.

According to the mode as recited in the aforementioned item [1], the right type of a replacement toner cartridge is determined depending on which is received from an image forming apparatus, first information indicating that a toner cartridge has been replaced with a new one or second information indicating that the remaining amount of toner contained in a toner cartridge reaches a predetermined value. And then, an instruction to deliver a replacement toner cartridge of the determined type is outputted.

Most of users who wish to have a replacement toner cartridge always in stock would like to receive a replacement toner cartridge soon after replacing a toner cartridge with a new one; most of users who do not wish to have a replacement toner cartridge always in stock because of limitations of office space or the like would like to receive a replacement toner cartridge before the current toner cartridge is empty.

In order to meet their requirements, according to this mode, the right type of a replacement toner cartridge is determined depending on which is received from an image forming apparatus, the first information indicating that a toner cartridge has been replaced with a new one or the second information indicating that the remaining amount of toner contained in a toner cartridge reaches a predetermined value. Specifically, if the second information indicating that the remaining amount of toner contained in a toner cartridge reaches a predetermined value is received, detecting a new toner cartridge will not be needed any more. In such a case, an instruction to deliver a replacement toner cartridge having a simple structure is outputted, and the costs of toner cartridges therefore can be saved.

According to the mode as recited in the aforementioned item [2], if the second information indicating that the remaining amount of toner contained in a toner cartridge reaches a predetermined value is received, detecting a new toner cartridge will not be needed any more. In such a case, an instruction to deliver a replacement toner cartridge not having a new toner cartridge detection feature is outputted, and the costs of toner cartridges therefore can be saved without adversely affecting the user. If the first information indicating that a toner cartridge has been replaced with a new one is received, detecting a new toner cartridge will be definitely needed. In such a case, an instruction to deliver a replacement toner cartridge having a new toner cartridge detection feature is outputted as is conventionally done.

According to the mode as recited in the aforementioned item [3], if a toner cartridge is detected as being nearly empty, an instruction to deliver a replacement toner cartridge not having a new toner cartridge detection feature is outputted, and the user can more surely receive it before the current toner cartridge is empty.

According to the mode as recited in the aforementioned item [4], if a delivery instruction given by a user is received by the receiver along with the first information or the second information from the image forming apparatus, the right type of a replacement toner cartridge is determined, and a delivery instruction is outputted after the user submits his/her order. Therefore, possible troubles with the user over order confirmation can be prevented.

According to the mode as recited in the aforementioned item [5], an instruction to deliver a replacement toner cartridge of the determined type is automatically transmitted to an order receiving server.

According to the mode as recited in the aforementioned item [6], if the second information indicating that the remaining amount of toner contained in a toner cartridge reaches a predetermined value is received, an instruction to deliver a replacement toner cartridge having a simple structure is outputted. In this way, the image forming apparatus can contribute to the saving on the costs of toner cartridges.

According to the mode as recited in the aforementioned item [7], if the second information indicating that the remaining amount of toner contained in a toner cartridge reaches a predetermined value is detected, an instruction to deliver a replacement toner cartridge not having a new toner cartridge detection feature is outputted. In this way, the image forming apparatus can contribute to the saving on the costs of toner cartridges. If the first information indicating that a toner cartridge has been replaced with a new one is detected, an instruction to deliver a replacement toner cartridge having a new toner cartridge detection feature is outputted as is conventionally done.

According to the mode as recited in the aforementioned item [8], if a toner cartridge is detected as being nearly empty, an instruction to deliver a replacement toner cartridge not having a new toner cartridge detection feature is outputted, and the user can more surely receive it before the current toner cartridge is empty.

According to the mode as recited in the aforementioned item [9], a delivery instruction is outputted after the user submits his/her order, and possible troubles with the user over order confirmation can be prevented.

According to the mode as recited in the aforementioned item [10], an instruction to deliver a replacement toner cartridge of the determined type is automatically transmitted to an order receiving server.

According to the mode as recited in the aforementioned item [11], if the second information indicating that the remaining amount of toner contained in a toner cartridge reaches a predetermined value is received, an instruction to deliver a replacement toner cartridge having a simple structure is outputted. In this way, the management system can contribute to the saving on the costs of toner cartridges.

According to the mode as recited in the aforementioned item [12], if the second information indicating that the remaining amount of toner contained in a toner cartridge reaches a predetermined value is received, an instruction to deliver a replacement toner cartridge not having a new toner cartridge detection feature is outputted. In this way, the image forming apparatus can contribute to the saving on the costs of toner cartridges. If the first information indicating that a toner cartridge has been replaced with a new one is received, an instruction to deliver a replacement toner cartridge having a new toner cartridge detection feature is outputted as is conventionally done.

According to the mode as recited in the aforementioned item [13], if a toner cartridge is detected as being nearly empty, an instruction to deliver a replacement toner cartridge not having a new toner cartridge detection feature is outputted, and the user can more surely receive it before the current toner cartridge is empty.

According to the mode as recited in the aforementioned item [14], a delivery instruction is outputted after the user submits his/her order, and possible troubles with the user over order confirmation can be prevented.

According to the mode as recited in the aforementioned item [15], an instruction to deliver a replacement toner cartridge of the determined type is automatically transmitted to an order receiving server.

According to the mode as recited in the aforementioned item [16], if the second information indicating that the remaining amount of toner contained in a toner cartridge reaches a predetermined value is received, an instruction to deliver a replacement toner cartridge having a simple structure is outputted, and the costs of toner cartridges therefore can be saved.

According to the mode as recited in the aforementioned item [17], if the second information indicating that the remaining amount of toner contained in a toner cartridge reaches a predetermined value is received, the computer of the replacement toner cartridge management apparatus executes a process of outputting an instruction to deliver a replacement toner cartridge having a simple structure.

According to the mode as recited in the aforementioned item [18], if the second information indicating that the remaining amount of toner contained in a toner cartridge reaches a predetermined value is received, the computer of the image forming apparatus executes a process of outputting an instruction to deliver a replacement toner cartridge having a simple structure.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. A replacement toner cartridge management apparatus comprising:

a receiver which receives first information indicating that a toner cartridge has been replaced with a new one and second information indicating that the remaining amount of toner contained in the toner cartridge reaches a predetermined value, from one or more than one image forming apparatus which the replacement toner cartridge management apparatus can access via a communication circuit;

a determiner which determines a right type of a replacement toner cartridge to be loaded in place of the toner cartridge causing the first information or the second information, depending on which is received by the receiver, the first information or the second information; and a transmitter which outputs an instruction to deliver a replacement toner cartridge of the type determined by the determiner.

2. The replacement toner cartridge management apparatus as recited in claim 1, wherein:

the type of replacement toner cartridge determined by the determiner is provided with or not provided with a new toner cartridge detection feature; and if the first information is received by the receiver, the determiner makes a first determination that a replacement toner cartridge provided with a new toner cartridge detection feature should be delivered, or if the second information is received by the receiver, the determiner makes a second determination that a replacement toner cartridge not provided with a new toner cartridge detection feature.

3. The replacement toner cartridge management apparatus as recited in claim 1, wherein the second information indicates the toner cartridge is nearly empty.

4. The replacement toner cartridge management apparatus as recited in claim 1, wherein if a delivery instruction given by a user is received by the receiver along with the first information or the second information from the image forming apparatus, the determiner makes the first determination or the second determination.

5. The replacement toner cartridge management apparatus as recited in claim 1, wherein the transmitter outputs the delivery instruction to an order receiving server for handling consumables order transactions, which the replacement toner cartridge management apparatus can access via a communication circuit.

6. An image forming apparatus comprising:

a detector which detects first information indicating that a toner cartridge loaded thereon has been replaced with a new one and second information indicating that the remaining amount of toner contained in the toner cartridge loaded thereon reaches a predetermined value;

a determiner which determines a right type of a replacement toner cartridge to be loaded in place of the toner cartridge causing the first information or the second information, depending on which is detected by the detector, the first information or the second information; and a transmitter which outputs an instruction to deliver a replacement toner cartridge of the type determined by the determiner.

7. The image forming apparatus as recited in claim 6, wherein:

the type of replacement toner cartridge determined by the determiner is provided with or not provided with a new toner cartridge detection feature; and if the first information is detected by the detector, the determiner makes a first determination that a replacement toner cartridge provided with a new toner cartridge detection feature should be delivered, or if the second information is detected by the detector, the determiner makes a second determination that a replacement toner cartridge not provided with a new toner cartridge detection feature.

8. The image forming apparatus as recited in claim 6, wherein the second information indicates that a toner cartridge is nearly empty.

9. The image forming apparatus as recited in claim 6, further comprising a display, wherein:

if the first information or the second information is detected by the detector, an order placement button is displayed on the display; and if the order placement button is pressed by a user, the determiner makes the first determination or the second determination.

10. The image forming apparatus as recited in claim 6, wherein the transmitter outputs the delivery instruction to an order receiving server for handling consumables order transactions which the replacement toner cartridge management apparatus can access via a communication circuit.

11. A replacement toner cartridge management system comprising one or more than one image forming apparatus having one or more than one toner cartridge loaded thereon and a management server which can access each other via a communication circuit, wherein:

the image forming apparatus comprises a transmitter which transmits first information indicating that the toner cartridge has been replaced with a new one and second information indicating that the remaining amount of toner contained in the toner cartridge reaches a predetermined value; and the management apparatus comprises:

a receiver which receives the first information and the second information;

a determiner which determines a right type of a replacement toner cartridge to be loaded in place of the toner cartridge causing the first information or the second information, depending on which is received by the receiver, the first information or the second information; and a transmitter which outputs an instruction to deliver a replacement toner cartridge of the type determined by the determiner.

12. The replacement toner cartridge management apparatus as recited in claim 11, wherein:

the type of replacement toner cartridge determined by the determiner of the management apparatus is provided with or not provided with a new toner cartridge detection feature; and if the first information is received by the receiver of the management apparatus, the determiner of the management apparatus makes a first determination that a replacement toner cartridge provided with a new toner cartridge detection feature should be delivered, or if the second information is received by the receiver of the management apparatus, the determiner of the management apparatus makes a second determination that a replacement toner cartridge not provided with a new toner cartridge detection feature.

13. The replacement toner cartridge management system as recited in claim 11, wherein the second information indicates that a toner cartridge is nearly empty.

14. The replacement toner cartridge management system as recited in claim 11, wherein:

the image forming apparatus further comprises a display;

if an order placement button displayed on the display is pressed by a user, the transmitter of the image forming apparatus outputs a delivery instruction along with the first information or the second information; and if the delivery instruction is received along with the first information or the second information by the receiver of the management apparatus from the image forming apparatus, the determiner of the management apparatus makes the first determination or the second information.

15. The replacement toner cartridge management system as recited in claim 11, wherein the transmitter of the management apparatus outputs the delivery instruction to an order receiving server for handling consumables order transactions which the replacement toner cartridge management apparatus can access via a communication circuit.

16. A replacement toner cartridge management method implemented by a replacement toner cartridge management system comprising one or more than one image forming apparatus having one or more than one toner cartridge loaded thereon, and a management apparatus which can access each other via a communication circuit, comprising:

the image forming apparatus's transmitting first information indicating that the toner cartridge has been replaced with a new one and second information indicating that the remaining amount of toner contained in the toner cartridge reaches a predetermined value; and the management apparatus's:

receiving the first information and the second information;

determining a right type of a replacement toner cartridge to be loaded in place of the toner cartridge causing the first information or the second information, depending on which is received, the first information or the second information; and outputting an instruction to deliver a replacement toner cartridge of the determined type.

17. A non-transitory computer-readable recording medium having a replacement toner cartridge management program stored thereon to make a computer of a replacement toner cartridge management apparatus execute:

receiving first information indicating that a toner cartridge has been replaced with a new one and second information indicating that the remaining amount of toner contained in the toner cartridge reaches a predetermined value, from one or more than one image forming apparatus which the replacement toner cartridge management apparatus can access via a communication circuit;

determining a right type of a replacement toner cartridge to be loaded in place of the toner cartridge causing the first information or the second information, depending on which is received, the first information or the second information; and outputting an instruction to deliver a replacement toner cartridge of the determined type.

18. A non-transitory computer-readable recording medium having a replacement toner cartridge management program stored thereon to make a computer of an image forming apparatus execute:

detecting first information indicating that a toner cartridge loaded thereon has been replaced with a new one and second information indicating that the remaining amount of toner contained in the toner cartridge loaded thereon reaches a predetermined value;

determining a right type of a replacement toner cartridge to be loaded in place of the toner cartridge causing the first information or the second information, depending on which is received, the first information or the second information; and outputting an instruction to deliver a replacement toner cartridge of the determined type.

* * * * *